US008118104B2

(12) United States Patent
Fontenot, Jr. et al.

(10) Patent No.: US 8,118,104 B2
(45) Date of Patent: Feb. 21, 2012

(54) DOWNHOLE VALVE WITH PASS THROUGH ID

(75) Inventors: Huward Paul Fontenot, Jr., Spring, TX (US); Robert James Costo, Jr., The Woodlands, TX (US); Richard David Peer, Katy, TX (US)

(73) Assignee: Smith International, Inc., Houston, TX (US)

( * ) Notice: Subject to any disclaimer, the term of this patent is extended or adjusted under 35 U.S.C. 154(b) by 396 days.

(21) Appl. No.: 12/353,996

(22) Filed: Jan. 15, 2009

(65) Prior Publication Data

US 2009/0183883 A1 Jul. 23, 2009

Related U.S. Application Data

(60) Provisional application No. 61/021,731, filed on Jan. 17, 2008.

(51) Int. Cl.
*E21B 34/12* (2006.01)

(52) U.S. Cl. ..... 166/373; 166/334.1; 166/386; 175/318

(58) Field of Classification Search ..... 166/334.1, 166/373, 386, 332.1; 175/317, 318; 251/212
See application file for complete search history.

(56) References Cited

U.S. PATENT DOCUMENTS

| | | | | |
|---|---|---|---|---|
| 3,850,194 | A * | 11/1974 | Brown | 137/496 |
| 6,039,117 | A * | 3/2000 | Mueller | 166/312 |
| 6,830,107 | B2 * | 12/2004 | Allen | 166/332.4 |
| 6,918,452 | B2 * | 7/2005 | Chan et al. | 175/21 |
| 7,624,821 | B1 * | 12/2009 | Hall et al. | 175/231 |
| 7,798,249 | B2 * | 9/2010 | Tibbitts | 175/67 |
| 2003/0173088 | A1 * | 9/2003 | Livingstone | 166/324 |

* cited by examiner

*Primary Examiner* — Nicole Coy
(74) *Attorney, Agent, or Firm* — Osha Liang LLP

(57) ABSTRACT

A downhole valve assembly is attached to a drillstring and includes an upper drillstring connection, a lower drillstring connection, and a tubular body comprising a through bore, and further includes a weight activated mechanism configured to close the through bore when the drillstring is lifted.

16 Claims, 3 Drawing Sheets

DOWNHOLE VALVE WITH PASS THROUGH ID

CROSS-REFERENCE TO RELATED APPLICATIONS

This application, pursuant to 35 U.S.C. §119, claims priority to U.S. Provisional Application Ser. No. 61/021,731 filed Jan. 17, 2008. That application is incorporated by reference in its entirety.

BACKGROUND

1. Field of the Disclosure

Embodiments disclosed herein relate generally to downhole drilling components. More particularly, embodiments disclosed relate to apparatus and methods to control fluid communication to bottom hole assemblies.

2. Background Art

In the drilling, completing, or reworking of oil wells, a variety of downhole tools may be used. FIG. 1 shows one example of a conventional drilling system for drilling an earth formation. The drilling system includes a drilling rig 10 used to turn a drilling tool assembly 12 which extends downward into a wellbore 14. Drilling tool assembly 12 includes a drillstring 16, a bottom hole assembly ("BRHA") 18, and a drill bit 20, attached to the distal end of drillstring 16.

Drill string 16 may comprise several joints of drill pipe 16*a* connected end to end through tool joints 16*b*. Drillstring 16 may be connected, or "made-up", where drill pipe 16*a* is tightened to a certain amount. Drillstring 16 maybe disconnected, or "broken-out", where drill pipe 16*a* is loosened and taken apart. Drill string 16 transmits drilling fluid (through its central bore) and rotational torque from drill rig 10 to BHA 18. Drill pipe 16*a* provides a hydraulic passage through which drilling fluid is pumped. The drilling fluid discharges through selected-size orifices in the bit (e.g., "jets") for the purposes of cooling the drill bit and lifting rock cuttings out of wellbore 14 as it is drilled.

Bottom hole assembly 18 includes a drill bit 20 and may also include additional components attached between drill string 16 and drill bit 20. Examples of additional BHA components include drill collars, stabilizers, measurement-while-drilling ("MWD") tools, logging-while-drilling ("LWD") tools, and downhole motors.

In some instances, well-intervention operations may be conducted using single-strand or multi-strand wireline or cable for intervention in oil or gas wells. Logging while drilling (LWD) is the measurement of formation properties during the excavation of the hole, or shortly thereafter, through the use of tools integrated into the bottom hole assembly. LWD, while sometimes risky and expensive, has the advantage of measuring properties of a formation before drilling fluids invade deeply. Further, many wellbores prove to be difficult or even impossible to measure with conventional wireline tools, especially highly deviated wells. In these situations, LWD measurement ensures that some measurement of the subsurface is captured in the event that wireline operations are not possible.

During downhole operations, for example, drilling, workover, and/or completion, one or more fluids may be present in both the bore of the drillstring and an annulus region formed between the drillstring and casing in the wellbore. When making up or breaking out connections in a wellbore having fluids present in the bore and the annulus region, unwanted fluid flow may occur in that the fluid from the annulus may rush into and up the bore of the drillstring. Such an occurrence is called a "U-tubing" effect and is well known in the industry. The U-tubing effect may be caused by a disturbance in the fluid equilibrium of the wellbore. For example, the fluids in the different volumes (i.e., the bore and the annulus region) may attempt to "level out," thereby creating equilibrium in the wellbore. Making up and/or breaking out drillstring connections interrupts the equilibrium and causes the unwanted flow of fluid into the bore.

Accordingly, there exists a need for a device to control fluid flow through a drillstring bore during downhole operations such as when making up or breaking out connections. Also, a device through which wireline tools and cables may be run downhole with minimal restriction would be well received in industry.

SUMMARY OF THE DISCLOSURE

In one aspect, embodiments disclosed herein relate to a downhole valve assembly attached to a drillstring, the valve assembly including an upper drillstring connection, a lower drillstring connection, and a tubular body comprising a through bore, and further including a weight activated mechanism configured to close the through bore when the drillstring is lifted.

In other aspects, embodiments disclosed herein relate to a method to control fluid flow through a drillstring, the method including providing a downhole valve assembly proximate a bottom hole assembly, wherein the valve has a full bore clearance when in an open position, and further including closing the downhole valve assembly by lifting the drill string.

In other aspects, embodiments disclosed herein relate to a downhole valve assembly attached to a drillstring, the valve assembly including an upper drillstring connection, a lower drillstring connection, and a tubular body comprising a through bore, and a weight activated mechanism configured to close the through bore when the drillstring is lifted. The weight activated mechanism includes a fin valve disposed on a lower end of a valve body, the fin valve including a plurality of fin elements configured to provide a seal in the bore in a closed position.

Other aspects and advantages of the disclosure will be apparent from the following description and the appended claims.

DETAILED DESCRIPTION

In one aspect, embodiments disclosed herein relate to downhole drilling components. More particularly, embodiments disclosed herein relate to apparatus and methods for controlling fluid communication to a bottom hole assembly.

Still further, embodiments disclosed herein relate to a downhole valve assembly for controlling fluid flow through a bore to bottom hole assemblies. A weight activated downhole valve assembly of embodiments disclosed herein may be configured to control fluid flow through a drillstring bore during downhole operations such as when making up or breaking out connections, as well as allow wireline tools and cables to be run downhole through the bore with minimal restriction.

Figure 1:
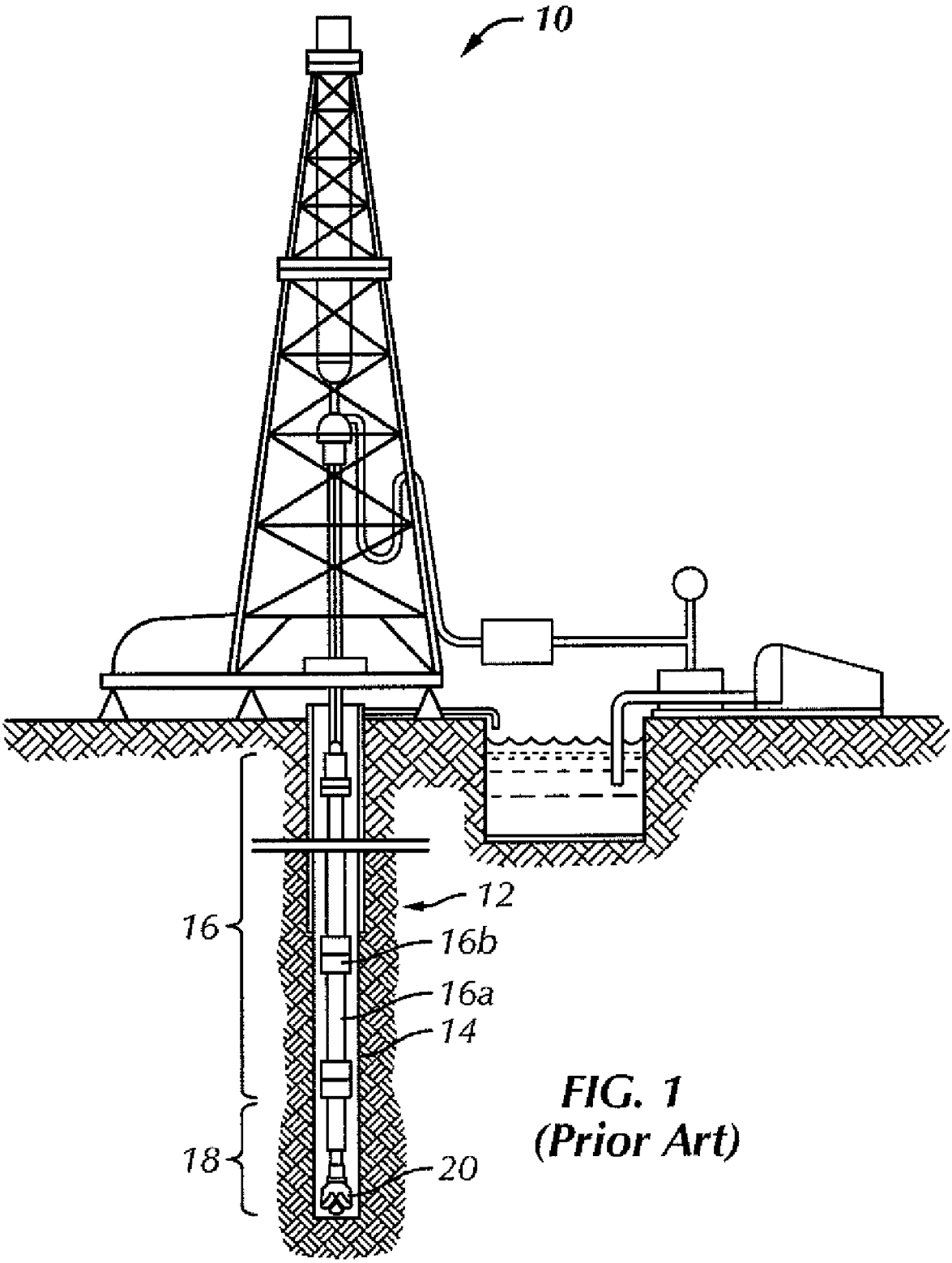
FIG. 1 (Prior Art)
FIG. 1 is a schematic diagram of a drilling system to drill earth formations in accordance with the prior art.
Figure 2A:
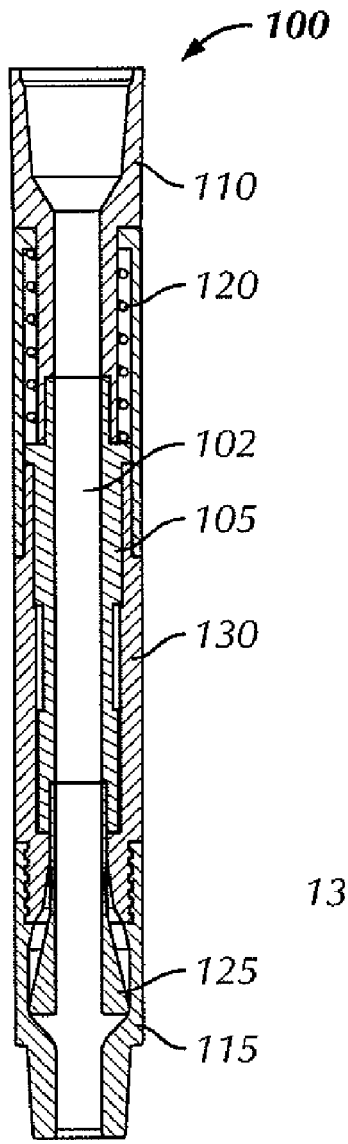
FIG. 2A is a section view of a downhole valve assembly in an open position in accordance with embodiments of the present disclosure.

Referring to FIG. 2A, a section view of a downhole valve assembly 100 is shown in accordance with embodiments of the present disclosure. Downhole valve assembly 100 includes an outer tubular body 130 which has a lower cap or sub 115 threadably engaged on its lower end. Further, a valve body 105 having a bore 102 therethrough and threadably engaged with an upper cap 110, and a spring 120 disposed between valve body 105 and upper cap 110 are enclosed within outer tubular body 130. Further, a fin valve 125 is attached to a lower end of valve body 105 and in bore 102. Upper cap 110 is configured to threadably attach to a drillstring (not shown), and lower sub 115 is configured to threadably engage a rotary tool.

Figure 2B:
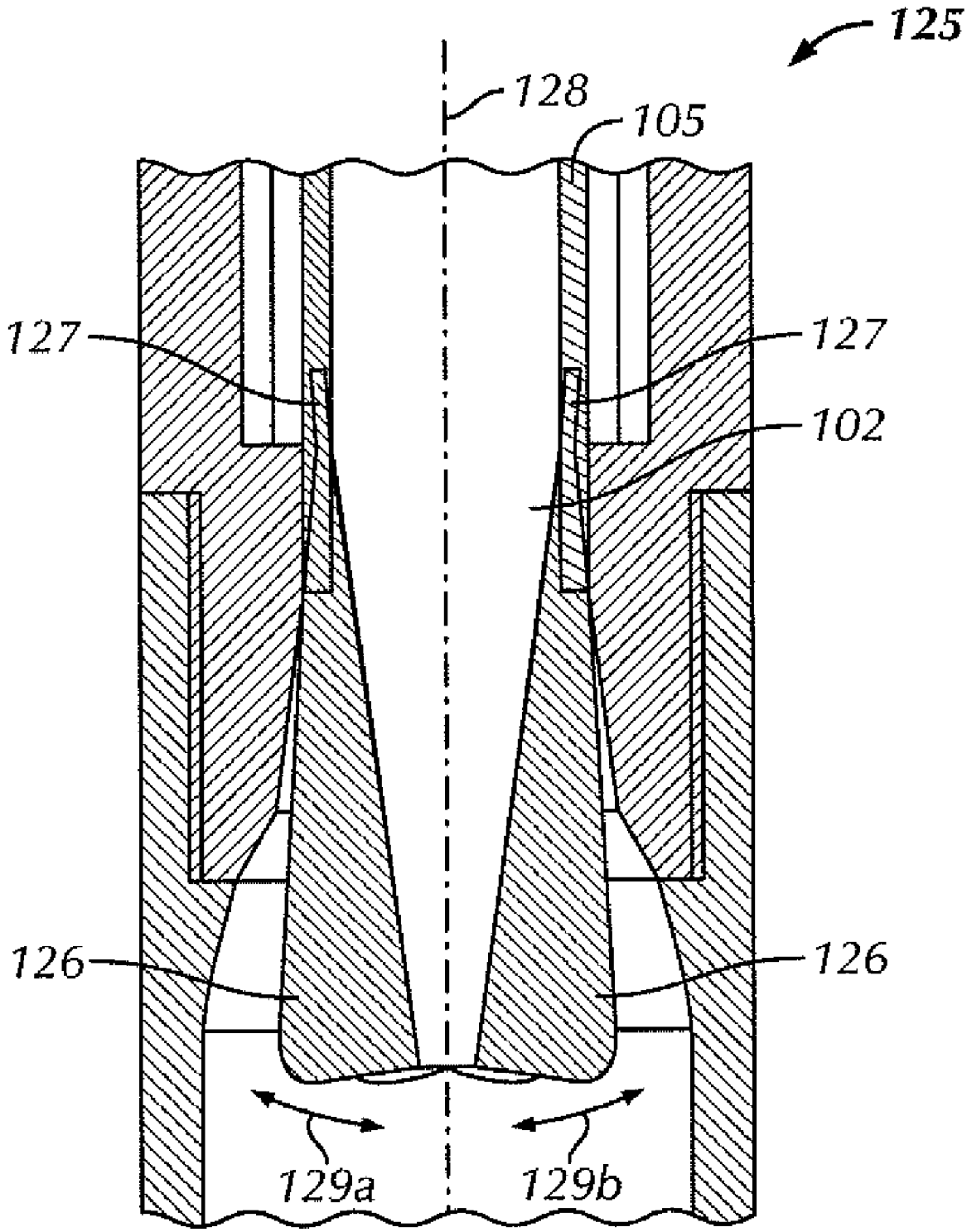
FIG. 2B is a section view of a fin valve in accordance with embodiments of the present disclosure.

Referring to FIG. 2B, a section view of fin valve 125 is shown in accordance with embodiments of the present disclosure. Fin valve 125 is attached to a lower end of valve body 105 through methods known to those skilled in the art. Fin valve 125 includes a plurality of fin elements 126 configured as individual "fingers" or "closing elements" which are configured to expand and allow fluid flow through bore 102, or compress and restrict fluid flow through bore 102 by forming a seal within. Further, fin elements 126 may seal on a wireline or other generally circular cross-sectioned object run through the bore of valve body 105.

In certain embodiments, fin valve 125 may include between three and six individual fin elements 126 configured to either expand or compress and mesh with each other. Fin elements 126 may be arranged in a circular configuration about a central axis 128 and attached to valve body 105 at "hinge" points 127. In this way, fin elements 126 may rotate or pivot about hinge point 127 in directions 129A, 129B when expanding or compressing.

In certain embodiments, fin elements 126 may have a triangular shape similar to that shown in the figures. However, one of ordinary skill in the art will appreciate that fin elements 126 may be configured in any useful shape, such as trapezoidal or rounded triangular, such that adequate sealing may be provided through bore 102. Further, fin elements 126 may be any polymer material known in the art. Various types of polymers may be selected and used depending upon downhole temperatures, drilling fluid types, or other downhole conditions known to those skilled in the art. In certain embodiments, fin elements 126 may be a polymer/steel combination. For example, fin elements 126 may be co-formed with a polymer material for sealing and a rigid steel backing for support.

Referring back to FIG. 2, downhole valve assembly 100 includes spring 120 positioned above valve body 105. The spring 120 may be a coiled spring, Belleville washer spring, or any other biasing mechanism known to those skilled in the art. Further, spring 120 may be formed of high cycle spring steel and other materials known to those skilled in the art.

Typically, downhole valve assembly 100 operates between an "open" position, in which fluid flow through bore 102 is allowed, and a "closed" position, in which fluid flow through the bore, is partially or filly restricted. Opening the valve and allowing fluid flow through the bore is accomplished by pushing down on downhole valve assembly 100, thereby applying weight on the bit ("WOB") or bottom hole assembly. In contrast, closing the bore is accomplished by lifting up on downhole valve assembly 100, thereby decreasing weight on the bit. Operation of downhole valve assembly 100 is described in more detail in three different positions: the open position, the closed position, and a "mid-stroke" position.

FIG. 2A shows downhole valve assembly 100 in the open or "free flowing" position which allows fluid flow 102 through the bore of downhole valve assembly 100 while drilling. In the open position, downhole valve assembly 100 may provide a full bore clearance allowing wireline cable or tools to be run downhole with minimal restriction. To configure downhole valve assembly 100 in the open position, weight is applied on the drillstring (not shown) which pushes downhole valve assembly 100 downward. Spring 120 is compressed against valve body 105 which forces fin valve 125 downward, allowing fin elements 126 (FIG. 2B) to expand radially outward into an upset region 117 in an inside diameter of lower sub 115. Fluid flow 102 or wireline cable and tools running through the bore push radially outward on fin elements 126 (FIG. 2B) of fin valve 125, keeping them in upset region 117. In certain embodiments, other biasing mechanisms may be used to maintain fin elements 126 in upset region 117, such as spring wire or other devices known to those skilled in the art.

Figure 3:
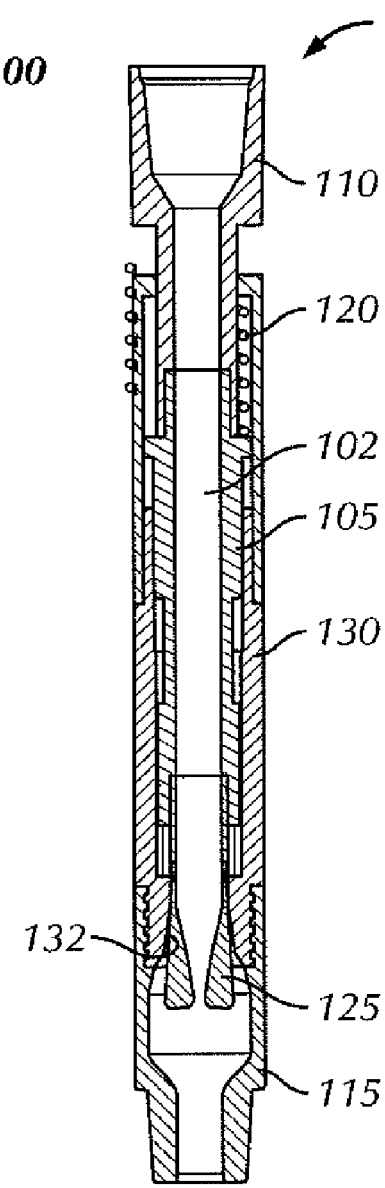
FIG. 3 is a section view of a downhole valve assembly in a mid-stroke position in accordance with embodiments of the present disclosure.

Referring now to FIG. 3, a section view of downhole valve assembly 100 in a partially closed, or mid-stroke, position is shown in accordance with embodiments of the present disclosure. When drilling stops and WOB is reduced (i.e., pulling upward on drillstring 101), spring 120 is compressed as valve body 105 is pulled upwards. As valve body 105 moves upward, fin valve 125 is pulled upward through a tapered opening 132 in tubular body 130. Tapered opening 132 provides that increasing forces may be applied to fin elements 126 (FIG. 2B) as they travel upward into bore 102 and diameter of tapered opening decreases. The configuration of tapered opening 132 provides a "wedging" action which compresses fin elements 126 (FIG. 2B) of fin valve 125 in bore 102. The wedging action provides the primary sealing force once the fin elements have fully compressed in the bore of downhole valve assembly 100. As shown in FIG. 3, valve body 105 is in the mid-stroke position, which in certain embodiments may be approximately 2.5 inches upward from the open position. In the mid stroke position, bore 102 may have a significant reduction of area, which will restrict fluid communication to the rotary tool (not shown).

Figure 4:
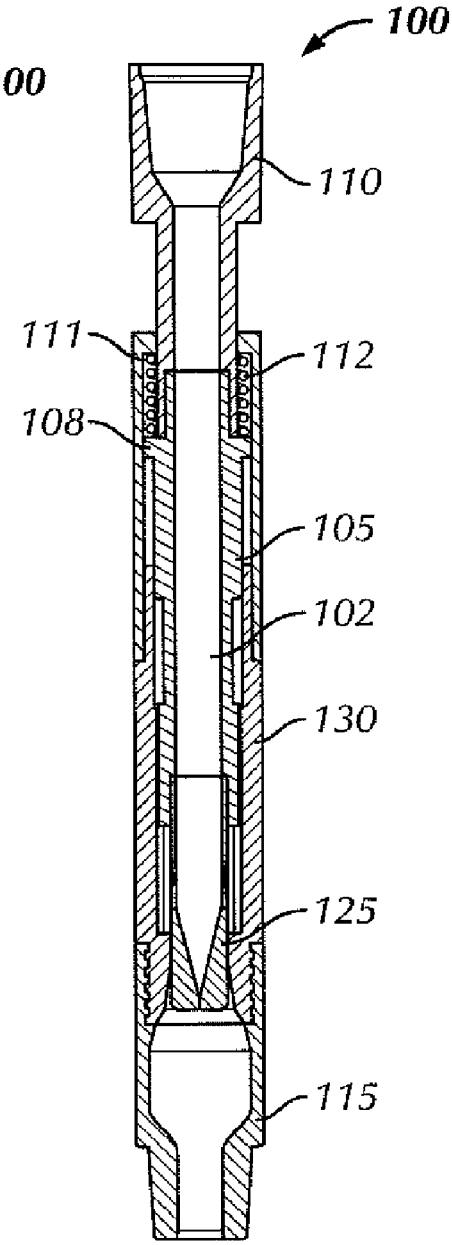
FIG. 4 is a section view of a downhole valve assembly in a closed position in accordance with embodiments, of the present disclosure.

Referring now to FIG. 4, a section view of downhole valve assembly 100 in a fully "closed" position is shown in accordance with embodiments of the present disclosure. In the closed position, spring 120 may be in full compression, or close to full compression, and bottomed against upper cap 110. Fin elements 126 (FIG. 2B) of fin valve 125 may be compressed, completely closing the ID of downhole valve assembly 100 and preventing fluid communication 102 to the BHA (not shown). Further, in alternate embodiments such as high temperature applications, fin elements 126 (FIG. 2B) of fin valve 125 may be configured to form a metal-to-metal seal in the bore which will be understood by those skilled in the art. In this instance, sealing forces provided by the wedging action of tapered 132 opening as described previously may be greater to form a sufficient metal-to-metal seal.

Further, in this position, when the stroke of downhole valve assembly 100 reaches a maximum, about five inches in certain embodiments, internal components may make shoulder to shoulder contact and allow tensile lifting loads to be transmitted through the outer tubular portion of valve body 105. For example, an upper end of spring 120 contacts a mating shoulder 111 of upper cap 110 and a lower end of spring 120 contacts a mating shoulder 108 of valve body 120, as shown in FIG. 4. In certain embodiments, in the event of a failure downhole, downhole valve assembly 100 may be configured to "fail" in the open position. The 'fail open' feature may be used in the event of a bottom hole assembly ("BHA") failure, when it may be necessary to pass certain tools through the bore with minimum restriction. This feature provides that downhole valve assembly 100 may never become stuck in the closed position, which may result in a loss of tools downhole.

In certain embodiments, downhole valve assembly 100 in a fully closed position may completely seal the bore, preventing any fluid communication to the BHA. In alternate embodiments, downhole valve assembly 100 in a fully closed position may partially seal the bore, reducing fluid communication to the BHA, but not completely shut if off. In still further embodiments, a wireline or other small diameter tubular may be run through the bore when downhole valve assembly 100 is closed, thereby closing the fin valve and sealing about the wireline. Small diameter tubular may include slick line tubing and wireline tools known to those skilled in the art. Further, the seal created in the bore by the fin valve may seal against fluid flow from the annulus attempting to flow up the bore, also called the U-tubing effect.

In certain embodiments, the downhole valve assembly may include a spline connection between an outer surface of the valve body and an inner surface of the mandrel. The spline connection may prevent rotation between the two components during the upward and downward movements of the downhole valve assembly, therefore limiting the movement between the two to vertical movement only. In further embodiments, the downhole valve assembly may be configured to allow rotational movement and vertical movement between the valve body and the mandrel which would be known to those skilled in the art.

In certain embodiments, downhole valve assembly may include a position indicator which transmits a signal to a drilling operator to indicate the current position of the fin valve. Pressure sensors, visual indicators, or other devices known to those skilled in the art may be used to indicate the position of the fin valve. The drilling operator may have a gauge, various light indicators, or other signaling components known to those skilled in the art to indicate the different positions of fin valve of the downhole valve assembly.

Advantageously, embodiments of the present disclosure provide a downhole valve assembly for controlling fluid communication to a BHA. The downhole valve assembly may simplify the downhole tool by replacing hydraulic systems used to seal the bore. The downhole valve assembly may reduce maintenance and improve reliability of the downhole valve assembly. Further, a rubber "fin cone" design of a fin valve may allow drilling operators to maintain a fully open ID while drilling, but a fully closed ID when making up and/or breaking out connections to reduce or prevent the U-tubing effect. Also, using the downhole valve assembly may allow wireline tools to be run through the fall ID of the drillstring with minimal restriction.

Still further, embodiments of the present disclosure may provide a shorter stroke that sealing elements must travel before sealing the ID of the drillstring, providing improved response time to seal the ID of the drillstring. Embodiments of the present disclosure further provide a fail open valve, where in the event of a BHA failure, the downhole valve assembly is automatically restored to an open position. This allows tools needed to access the BHA to pass through the ID with minimum restriction. Further, the ability to always access the BHA may decrease chances of losing tools downhole which may result in a loss of the well.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A method to control fluid flow through a drillstring, the method comprising:

providing a downhole valve assembly proximate a bottom hole assembly, wherein the valve assembly has a full bore clearance when in an open position;

disposing a biasing mechanism above a translatable valve body within the valve assembly, the valve body having a plurality of fin elements disposed on an end thereof, wherein the valve body is axially biased into an open position by the biasing mechanism; and closing the downhole valve assembly by lifting the drillstring and forming a seal with the plurality of fin elements in the bore.

2. The method of claim 1, further comprising forming a complete seal in the bore with the plurality of fin elements in a closed position.

3. The method of claim 1, further comprising forming a partial seal in the bore with the plurality of fin elements in a closed position.

4. The method of claim 1, further comprising wedging the plurality of fin elements against a tapered seat.

5. The method of claim 4, further comprising providing a primary sealing force between the plurality of fin elements.

6. A downhole valve assembly attached to a drillstring, the valve assembly comprising:

an upper drillstring connection, a lower drillstring connection, and a valve body comprising a central bore therethrough; and a weight activated mechanism configured to close the central bore when the drillstring is lifted, the mechanism comprising:

a plurality of fin elements configured to provide a seal in the central bore in a closed position; and a biasing mechanism positioned above the valve body configured to axially bias the plurality of fin elements on an end of the valve body into an open position.

7. The valve assembly of claim 6, wherein the valve body comprises a tapered seat configured to receive the plurality of fin elements.

8. The valve assembly of claim 7, wherein the tapered seat comprises an inclined surface configured to provide a wedging action between the plurality of fin elements and the inclined surface of the tapered seat to provide a primary sealing force.

9. The valve assembly of claim 6, wherein the lower drill-string connection comprises an upset region configured to allow the plurality of fin elements to expand.

10. The valve assembly of claim 6, wherein the plurality of fin elements are triangular-shaped.

11. The valve assembly of claim 6, wherein the plurality of fin elements are trapezoidal-shaped.

12. The valve assembly of claim 6, wherein the plurality of fin elements are a rounded triangular shape.

13. The valve assembly of claim 6, wherein the plurality of fin elements form a complete seal when closed.

14. The valve assembly of claim 6, wherein the plurality of fin elements form a partial seal when closed.

15. The valve assembly of claim 6, wherein the plurality of fin elements are configured to seal against a wireline cable through the bore of the tubular body.

16. The valve assembly of claim 6, wherein the plurality of fin elements are configured to seal against a wireline tool through the bore of the tubular body.

* * * * *